US010883732B2

(12) United States Patent
Seibold

(10) Patent No.: US 10,883,732 B2
(45) Date of Patent: Jan. 5, 2021

(54) AIR-CONDITIONING UNIT WITH IONIZER HAVING SELF-CLEANING ELECTRODES

(71) Applicant: FILT AIR LTD., Zikhron Yaaqov (IL)

(72) Inventor: Siegfried Seibold, Zikhron Yaaqov (IL)

(73) Assignee: Filt Air Ltd., Zikhron Yaaqov (IL)

( * ) Notice: Subject to any disclaimer, the term of this patent is extended or adjusted under 35 U.S.C. 154(b) by 78 days.

(21) Appl. No.: 15/994,194

(22) Filed: May 31, 2018

(65) Prior Publication Data

US 2019/0353359 A1 Nov. 21, 2019

(30) Foreign Application Priority Data

May 16, 2018 (IL) ..... 259445

(51) Int. Cl.
*B03C 3/41* (2006.01)
*F24F 3/16* (2006.01)
*B03C 3/74* (2006.01)

(52) U.S. Cl.
CPC ..... *F24F 3/166* (2013.01); *B03C 3/41* (2013.01); *B03C 3/743* (2013.01); *F24F 3/161* (2013.01); *F24F 2003/1682* (2013.01)

(58) Field of Classification Search
CPC .... F24F 3/166; F24F 13/28; F24F 3/02; F24F 3/04; F24F 3/06; F24F 3/065; F24F 3/08; F24F 3/10
See application file for complete search history.

(56) References Cited

U.S. PATENT DOCUMENTS 2,615,529 A * 10/1952 Lincoln ..... B03C 3/78 96/46
3,608,275 A * 9/1971 Wiemer et al. ..... B03C 3/08 96/34
3,844,742 A * 10/1974 Petersen ..... B03C 3/761 96/35
4,502,870 A * 3/1985 Wheeler ..... B03C 3/763 340/683
5,768,087 A 6/1998 Vernitskiy
6,464,754 B1 * 10/2002 Ford ..... B03C 3/38 361/226
7,408,759 B2 8/2008 Gefter et al.
7,969,707 B2 6/2011 Riskin
8,705,224 B2 * 4/2014 Riskin ..... H01T 23/00 361/230
8,957,571 B2 2/2015 Riskin
9,843,169 B2 12/2017 Riskin et al.
2001/0048030 A1 * 12/2001 Sharood ..... H02J 13/00001 236/49.3
2002/0184723 A1 * 12/2002 Bishop ..... A47L 13/16 15/118
2004/0079233 A1 4/2004 Lau et al.
2004/0237787 A1 12/2004 Reeves et al.
(Continued)

*Primary Examiner* — Larry L Furdge
*Assistant Examiner* — Alexis K Cox
(74) *Attorney, Agent, or Firm* — Dinsmore & Shohl LLP

(57) ABSTRACT

An air conditioner device having a housing or duct with an opening for exit of air and one or more rotatable flaps for adjusting air flow rate and angle exiting through the opening. An ionizer having an electrode is configured to ionize air exiting through the opening, and a cleaning pad is adapted to frictionally remove debris from the electrode consequent to rotation of the flaps without requiring manual operation by a user.

15 Claims, 4 Drawing Sheets

(56) References Cited

U.S. PATENT DOCUMENTS

| | | | | |
|---|---|---|---|---|
| 2005/0199125 | A1* | 9/2005 | Taylor | B03C 3/74<br>96/39 |
| 2005/0210902 | A1* | 9/2005 | Parker | F24F 3/166<br>62/230 |
| 2010/0188793 | A1 | 7/2010 | Uchida et al. | |
| 2011/0308768 | A1* | 12/2011 | Schwiebert | B08B 1/008<br>165/95 |
| 2015/0107456 | A1* | 4/2015 | Ursem | B03C 3/09<br>96/55 |

* cited by examiner

AIR-CONDITIONING UNIT WITH IONIZER HAVING SELF-CLEANING ELECTRODES

FIELD OF THE INVENTION

This invention relates generally to electrostatic ionizers for purifying air in air-conditioning units and ducts, and particularly to cleaning the electrodes in such devices.

BACKGROUND OF THE INVENTION

U.S. Pat. No. 9,843,169 discloses a bipolar ionizer circuit mounted in an air-conditioning duct or on the flaps of a wall-mounted air-conditioning unit that swing up and down to direct the air at varying angles. This allows the air emitted from the flaps of the air-conditioning unit to be ionized regardless of the direction of the flaps. During prolonged use, debris accumulates on the ionizing electrodes and must be removed.

Cleaning mechanisms for ionizing devices are also well-known. For example, U.S. Pat. No. 5,768,087 discloses a bipolar ionization device whose stationary ionizing electrodes are cleaned automatically. The electrode cleaning device is installed on a rotating part of the ventilator and is operated by centrifugal force.

US2010/0188793 discloses a bipolar ionization device with an automatic cleaning device operated by a drive implemented as a bi-directional solenoid.

U.S. Pat. No. 8,705,224 discloses a bipolar ion generator having a pair of deflectable ionizing electrodes rotatable by a variable speed electric motor. In a cleaning mode, the motor speed is increased so as to deflect the electrodes under centrifugal force thereby contacting a stationary cleaning unit and removing dust collected on the electrodes.

U.S. Pat. No. 7,969,707 discloses a device for bipolar ionization with automatic electrode cleaning facility, in which both the ionizing electrodes and the cleaning device are mounted on the rotating part of a ventilator. The cleaning device is operated by means of centrifugal force.

U.S. Pat. No. 8,957,571 discloses an ionizing electrode with a solenoid-operated cleaning mechanism.

U.S. Pat. No. 7,408,759 discloses a device for generating ions in a flowing air stream. Multiple filamentary ion-generating electrodes are rotatable relative to a support structure for wiping the surface of the filament and removing accumulated debris.

US20040079233 discloses an electrostatic air conditioner device having first and second electrode arrays. A manually-operated cleaning mechanism includes a length of flexible insulating material that frictionally cleans the electrodes in the first array as a user moves the second electrode array up or down within the conditioner housing.

US20040237787 discloses an air conditioner with a cleaning member having an opening, through which a wire-like electrode passes. The cleaning member is moved along the wire to frictionally clean the wire-like electrode when a collector electrode array is moved manually by a user.

SUMMARY OF THE INVENTION

It is an object of the invention to provide a simple cleaning device for cleaning the electrodes of an ionizing device mounted in association with an air-conditioning unit.

This object is realized in accordance with the present invention by an air conditioner device having a housing, one or more flaps, an ionizer and a cleaning pad.

Specifically, there is provided an air conditioner device that includes a housing or duct having an opening for exit of air, one or more rotatable flaps for adjusting the flow rate and angle of air exiting through the opening, an ionizer having an electrode configured to ionize the air exiting through the opening, and a cleaning pad adapted to frictionally remove debris from the electrode consequent to rotation of the flaps without requiring manual operation by a user.

The ionizer can be fixed inside the housing in such a position and orientation that its electrode is wiped by a cleaning pad mounted on the air conditioner flap. Alternatively, the ionizer can be mounted on the air conditioner flap and the cleaning pad can be fixed inside the housing in such a position and orientation so as to wipe against the ionizer electrode. In either case, rotation of the air conditioner flap induces relative movement between the ionizer electrode and the cleaning pad and the consequent abrasion cleans the electrode. This is particularly effective and advantageous in those types of air conditioner unit that have motorized flaps that are programmed to rotate up and down periodically, and when the flaps are closed completely the ionizer electrode is then wiped clean automatically without the need for user interaction.

While frictional cleaning of ionizer electrodes mounted in association with an air conditioner is known in the art, there appears to have been no suggestion to exploit the rotary motion of the air conditioner flap to achieve this in a-cyclic manner with no need for manual operation or intervention by the user.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

In the following description of some embodiments, identical components that appear in more than one figure or that share similar functionality will be referenced by identical reference symbols.

Figure 1A:
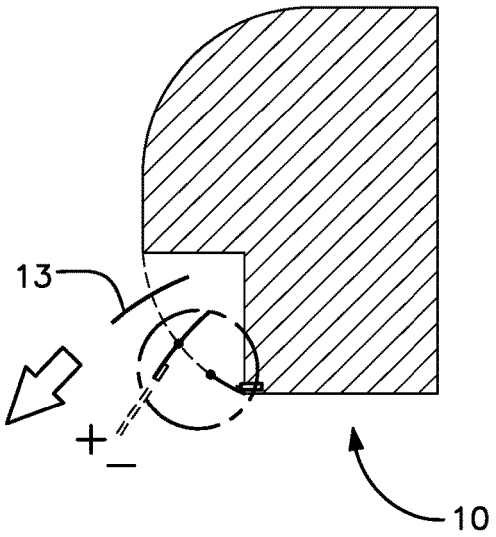
FIG. 1*a* is an end elevation of a wall-mounted air-conditioner unit having an ionizer mounted on a rotatable flap for cleaning by a fixed pad.
Figure 1B:
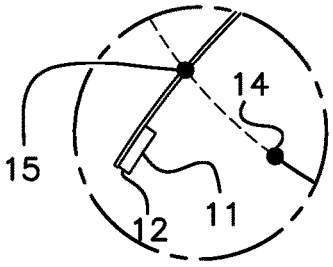
FIG. 1*b* is an enlarged view showing the spatial relationship between the ionizer electrode and the pad.
Figure 1C:
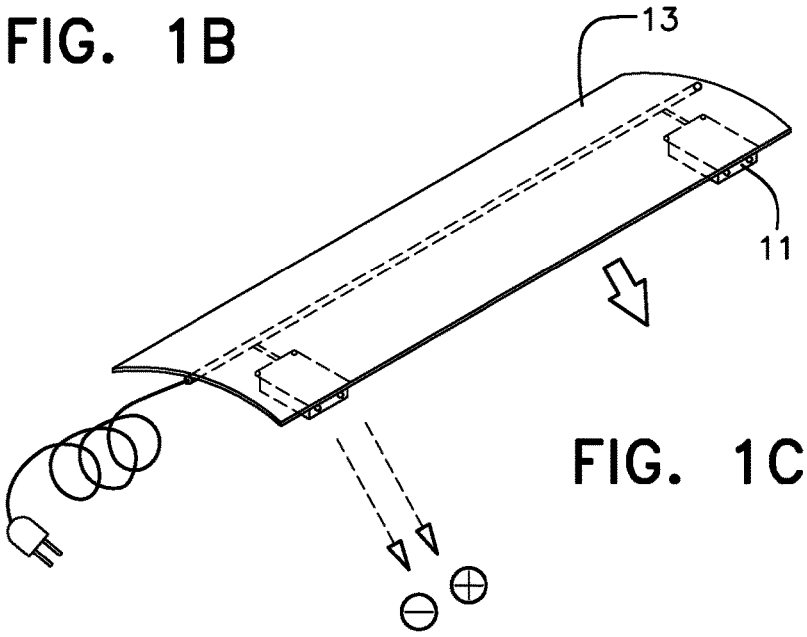
FIG. 1*c* is a pictorial view of the air-conditioner flap.

FIGS. 1*a* to 1*c* show schematically a wall-mounted air-conditioner unit 10 having one or more ionizers 11 each having a respective ionizer electrode 12 mounted at the front edge of a rotatable flap 13 for cleaning by a respective fixed pad 14 mounted at a bottom edge of the air-conditioner unit 10. In one mode of operation, the flap 13 continuously swings up and down about an axis 15 to direct the air at varying angles rather than direct it in one fixed direction. In this mode of operation, the flap swings up and down during each cycle and, on shutting down the air-conditioner the ionizer electrode 12 on each ionizer 11 brushes against the respective fixed pad 14 and is wiped clean thereby. Typically, during regular operation, the flaps do not completely close and the ionizer electrodes are cleaned only on shutting down the air-conditioner, when the flap 13 is closed with sufficient force to wipe the ionizer electrode clean. In an alternative mode of operation, the flap is adjusted by the user to a specific angle and remains at this angle during operation of the air-conditioner. However, on switching off the air-conditioner, the flap 13 closes and, in so doing, automatically cleans the ionizer electrode.

Figure 2A:
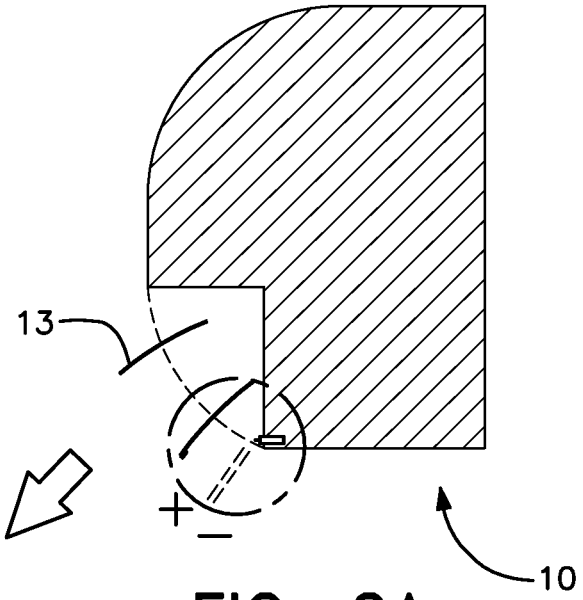
FIG. 2*a* is an end elevation of a wall-mounted air-conditioner unit having a cleaning pad mounted on a rotatable flap for wiping a fixed ionizer electrode.
Figure 2B:
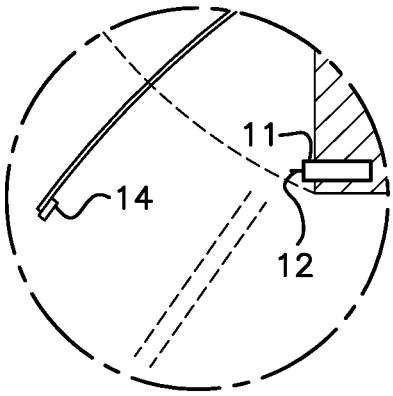
FIG. 2*b* is an enlarged view showing the spatial relationship between the ionizer electrode and the pad.
Figure 2C:
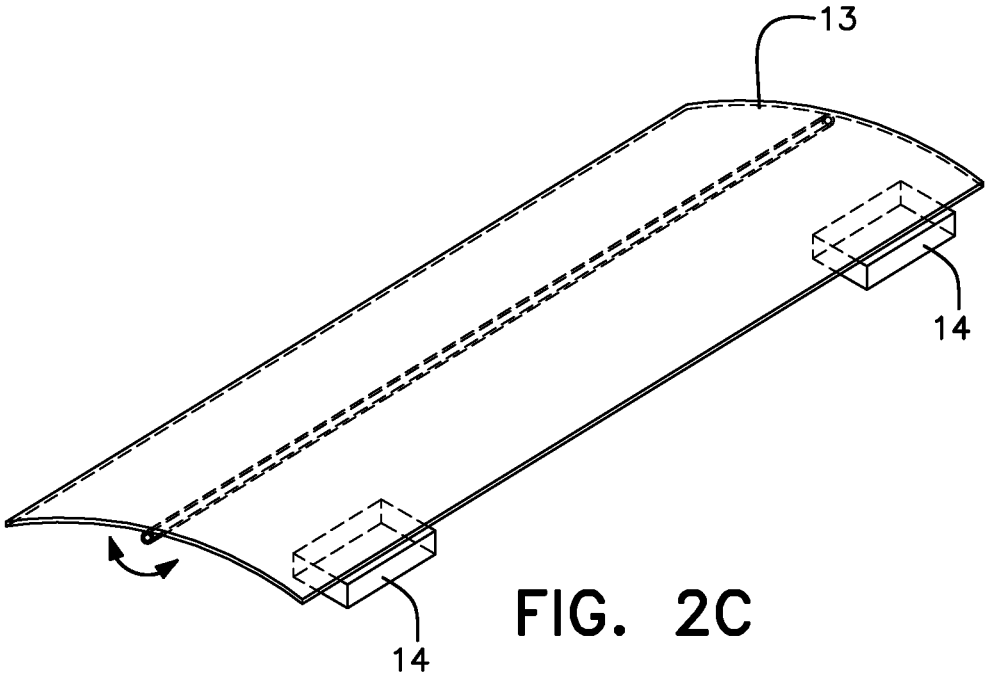
FIG. 2*c* is a pictorial view of the air-conditioner flap.

FIGS. 2*a* to 2*c* show schematically an air-conditioner unit 10 similar to that described above and functionality identical except that the positions of the ionizers 11 and the cleaning pads 14 are exchanged. As the flap closes when switching off the air-conditioner, the pad 14 brushes against the respective electrode of the fixed ionizer 11 and wipes it clean.

Figure 3A:
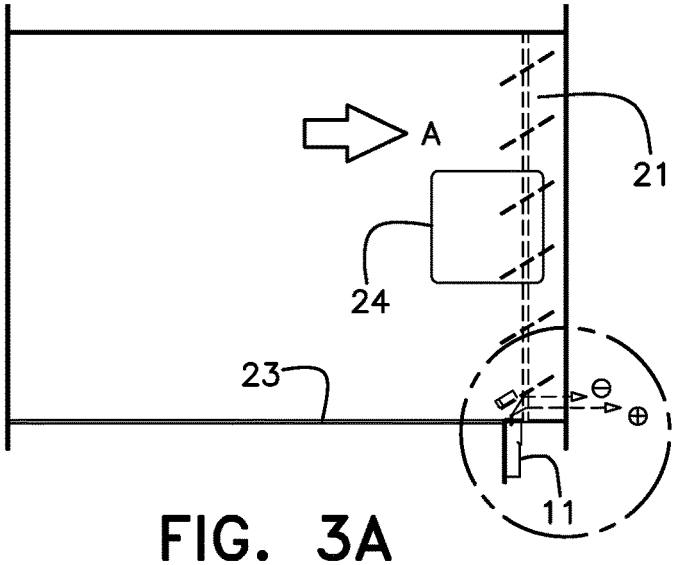
FIG. 3*a* is a side elevation of a rectangular air duct with a cleaning pad mounted on a rotatable flap for cleaning a fixed ionizer electrode.
Figure 3B:
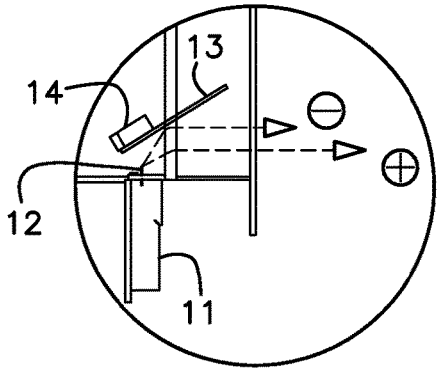
FIG. 3*b* is an enlarged view showing the spatial relationship between the ionizer electrode and the pad.
Figure 3C:
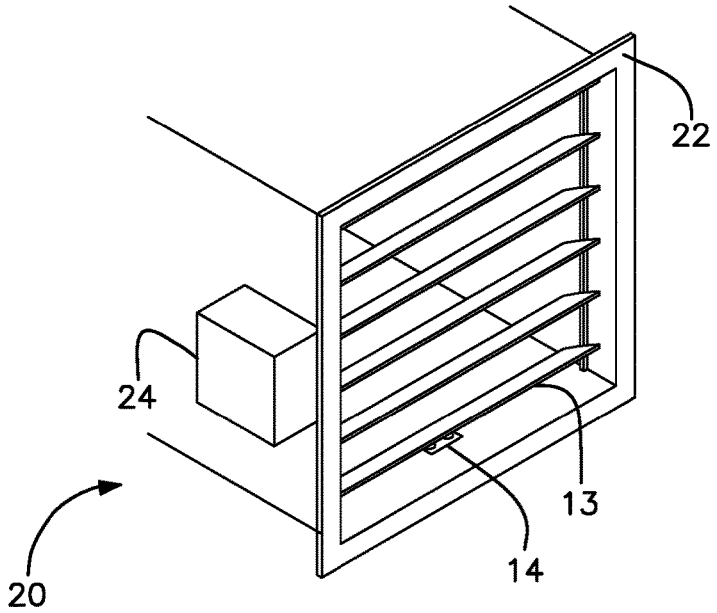
FIG. 3*c* is a pictorial view of a front grate having multiple flaps.

FIGS. 3*a* to 3*c* show schematically an air conditioning duct 20 having a rectangular cross-section through which air is conveyed by a fan or blower (not shown) in the direction of the arrow A to an opening 21 covered by a grate 22 having a plurality of flaps 13 that are articulated so as to open and close in unison. A cleaning pad 14 is mounted on the lowest flap 13 and is so oriented that it wipes the electrode of an ionizer 11 mounted on an inside base 23 of the duct when the flap is closed. The ionizer 11 may be an ionizer bar having multiple ionizers that is mounted as shown in FIG. 3*c* and which produces ions that are deflected in a forward direction by the flap. However, the invention also embraces the possibility that the locations of the ionizer and the pad are reversed since it is their relative movement that induces cleaning of the ionizer electrode. Commonly, in this type of air conditioning system the flaps 13 do not swing but are opened to a required angle by an actuator in order to adjust the volumetric air flow. The flaps may be provided with a spring-activated safety mechanism that shuts the flaps automatically in the event of power loss or when the air conditioning unit is shut down and serves to prevent fire or smoke spreading through the duct into the room. Alternatively, as shown in the figure there may be provided an actuator 24 commonly such as the Aprilaire 6506 motorized normally-closed damper, which is compatible with either rigid metal or flex duct and automatically closes the flaps 13 with sufficient force when the air conditioning system is shut down, whereupon the cleaning pad 14 wipes the ionizing electrode 12 clean.

Figure 4A:
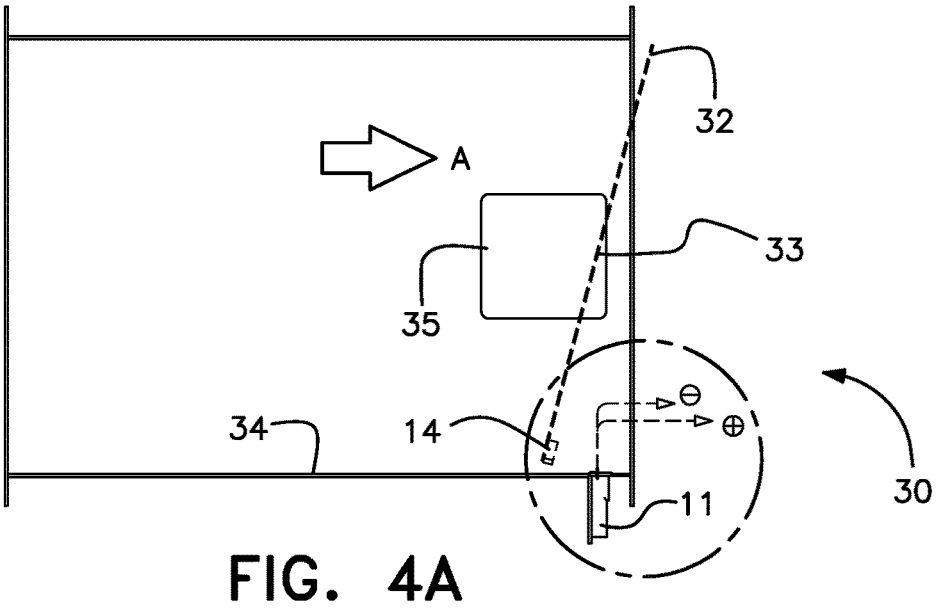
FIG. 4*a* is a side elevation of a circular air duct with a cleaning pad mounted on a rotatable flap for cleaning a fixed ionizer electrode.
Figure 4B:
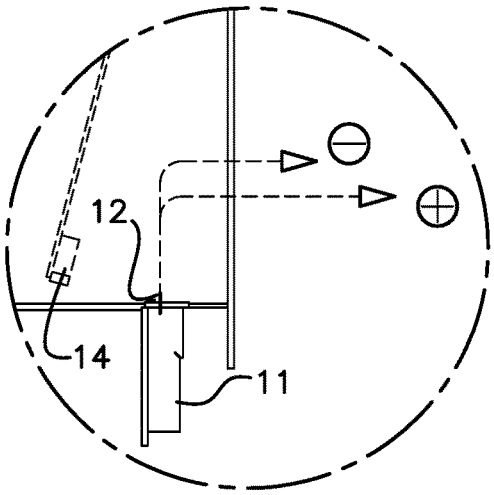
FIG. 4*b* is an enlarged view showing the spatial relationship between the ionizer electrode and the pad.
Figure 4C:
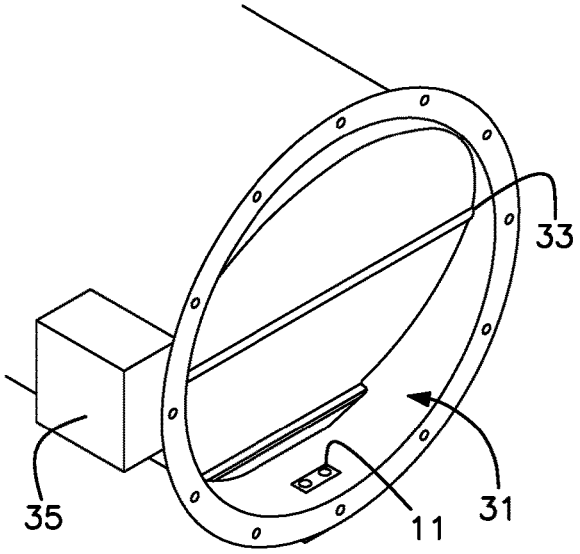
FIG. 4*c* is an enlarged pictorial view of the flap.

FIGS. 4*a* to 4*c* show schematically an air conditioning duct 30 of circular cross-section through which air is conveyed by a fan or blower (not shown) in the direction of the arrow A to an opening 31 covered by a shutter 32 in the form of a circular flap that is hinged about an axis 33. A cleaning pad 14 is mounted at a lower periphery of the shutter 32 and is so oriented that it wipes the electrode of an ionizer 11 mounted on a lower inside surface 34 of the duct when the flap is closed. The ionizer 11 may be an ionizer bar having multiple ionizers that is mounted as shown in FIG. 4*c* and whose ionizing electrodes 12 are bent so as to direct ions in a forward direction coaxially with the longitudinal axis of the duct. However, the invention also embraces the possibility that the locations of the ionizer and the pad are reversed since it is their relative movement that induces cleaning of the ionizer electrode. Here, also, a normally-closed damper 35 is articulated to the hinge axis 33 and automatically closes the shutter 32 under force when the air conditioning system is shut down, whereupon the cleaning pad 14 wipes the ionizing electrode 12 clean.

It will be understood that although in FIGS. 1*a* and 2*a* the air conditioning unit is wall-mounted, the invention is equally applicable for use with floor standing units and with ceiling units (cassette).

It is also to be noted that the invention may be used with many different types of ionizing electrodes such as a stiff metal emitter (needle point), flexible wire, and brush type emitters consisting of a plurality of bristles (carbon fibers). Likewise, the cleaning pad may be a brush type pad having a plurality of bristles, a soft abrasive material (scotch) or an unwoven polymer/fabric strip. These are provided by way of example only, other options being apparent to those skilled in the art.

It should also be noted that features that are described with reference to one or more embodiments are described by way of example rather than by way of limitation to those embodiments. Thus, unless stated otherwise or unless particular combinations are clearly inadmissible, optional features that are described with reference to only some embodiments are assumed to be likewise applicable to all other embodiments also.

The invention claimed is:

1. An air conditioner device, comprising:

a housing or duct having an opening for exit of air flowing parallel to a longitudinal axis of the housing or duct, one or more rotatable flaps that span across said opening and each of which is adapted to swing about a respective axis of the flap substantially normal to said longitudinal axis to adjust airflow rate and angle of the air exiting through said opening, an ionizer having an electrode for ionizing the air exiting through said opening, and a cleaning pad positioned on the air conditioner device to frictionally remove debris from said electrode as a consequence to rotation of the one or more flaps about the respective axis without requiring manual operation by a user, wherein the ionizer is mounted in the housing or duct and the cleaning pad is mounted on one of the one or more rotatable flaps.

2. The air conditioner device according to claim 1, wherein the air conditioner device is a wall-mounted unit.

3. The air conditioner device according to claim 1, wherein the air conditioner device is a floor standing unit.

4. The air conditioner device according to claim 1, wherein the air conditioner device is a ceiling unit.

5. The air conditioner device according to claim 1, wherein the air conditioner device is configured to convey air through said opening in the housing or a duct and includes a mechanism that closes said one or more rotatable flaps when the air conditioner device is shut down.

6. The air conditioner device according to claim 5, wherein the duct is rectangular and the opening is covered by a grate, said one or more rotatable flaps including a plurality of flaps associated with said grate, said plurality of flaps being opened and closed in unison by an actuator.

7. The air conditioner device according to claim 5, wherein the duct is circular and said one or more rotatable flaps is a shutter having a hinge axis articulated to a motorized damper.

8. The air conditioner device according to claim 5, wherein the duct is rectangular and the opening is covered by a grate, said one or more rotatable flaps including a plurality of flaps associated with said grate.

9. The air conditioner device according to claim 8, wherein said mechanism is an actuator, said plurality of flaps being opened and closed in unison by said actuator.

10. The air conditioner device according to claim 1, wherein the ionizing electrode is formed of stiff metal.

11. The air conditioner device according to claim 1, wherein the ionizing electrode is formed of flexible wire.

12. The air conditioner device according to claim 1, wherein the ionizing electrode is formed of a plurality of bristles.

13. The air conditioner device according to claim 1, wherein the cleaning pad is a brush type pad having a plurality of bristles.

14. The air conditioner device according to claim 1, wherein the cleaning pad is formed of abrasive material.

15. The air conditioner device according to claim 1, wherein the cleaning pad is formed of an unwoven polymer/fabric strip.

* * * * *